US012685382B2

(12) United States Patent
Proctor

(10) Patent No.: US 12,685,382 B2
(45) **Date of Patent: *Jul. 21, 2026**

(54) FALSE EYELASH DISPENSING DEVICE

(71) Applicant: True Perspective LLC, Frisco, TX (US)

(72) Inventor: Shyri Proctor, Cedar Hill, TX (US)

(73) Assignee: True Perspective LLC, Frisco, TX (US)

( * ) Notice: Subject to any disclaimer, the term of this patent is extended or adjusted under 35 U.S.C. 154(b) by 93 days.

This patent is subject to a terminal disclaimer.

(21) Appl. No.: 18/890,595

(22) Filed: Sep. 19, 2024

(65) Prior Publication Data

US 2025/0009110 A1 Jan. 9, 2025

Related U.S. Application Data

(63) Continuation of application No. 17/716,987, filed on Apr. 8, 2022, now Pat. No. 12,114,757, which is a continuation-in-part of application No. 16/778,863, filed on Jan. 31, 2020, now abandoned.

(51) Int. Cl.
*A41G 5/02* (2006.01)
*A45D 44/00* (2006.01)

(52) U.S. Cl.
CPC ..... *A45D 44/00* (2013.01); *A41G 5/02* (2013.01); *A45D 2200/052* (2013.01); *A45D 2200/10* (2013.01)

(58) Field of Classification Search
CPC ..... A45D 26/0066; A45D 2026/0095; A45D 2200/10; A41G 5/0086; A41G 5/02
See application file for complete search history.

(56) References Cited

U.S. PATENT DOCUMENTS

| | | | |
|---|---|---|---|
| 2,413,998 | A | 1/1947 | Scott |
| 2,667,176 | A | 1/1954 | Wassmer |
| 10,264,869 | B2 | 4/2019 | Brouillet et al. |
| 11,617,406 | B1 | 4/2023 | Fiala |
| 2012/0000957 | A1 | 1/2012 | Martinez |
| 2014/0261514 | A1 | 9/2014 | Martins et al. |
| 2014/0263392 | A1 | 9/2014 | Martins et al. |

(Continued)

FOREIGN PATENT DOCUMENTS

WO 2013171405 A1 11/2013

OTHER PUBLICATIONS

International Search Report and Written Opinion, PCT/US2023/017694, mailed Jul. 13, 2023.

*Primary Examiner* — Rachel R Steitz
(74) *Attorney, Agent, or Firm* — Master Key IP, LLP; Justin G. Sanders

(57) ABSTRACT

A false eyelash dispensing device is disclosed. In at least one embodiment, a lash belt removably supports at least one lash strip thereon. An elongate housing is sized and configured for receiving the at least one lash belt therewithin. Upon a button being manually depressed after the at least one lash belt is selectively advanced so as to position a lash strip directly in front of an exit opening of the housing, the button is configured for causing an eyelash holder to temporarily engage with said lash strip, and moving the eyelash holder from a retracted position to an extended position, thereby detaching said lash strip from the lash belt and moving said lash strip through the exit opening so that said lash strip may be subsequently applied to the user's eyelid while engaged with the eyelash holder.

20 Claims, 8 Drawing Sheets

(56) References Cited

U.S. PATENT DOCUMENTS

| | | | |
|---|---|---|---|
| 2015/0181968 | A1 | 7/2015 | Uresti |
| 2015/0201692 | A1 | 7/2015 | Hansen et al. |
| 2017/0006947 | A1 | 1/2017 | Uresti |
| 2017/0253419 | A1 | 9/2017 | Roh et al. |

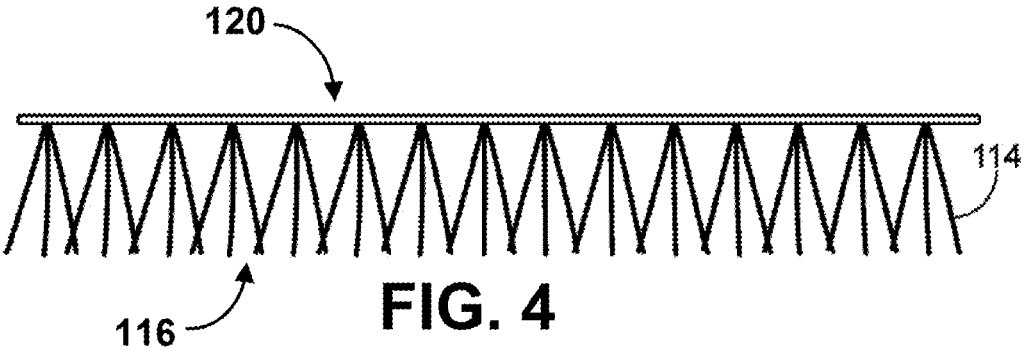
FIG. 4
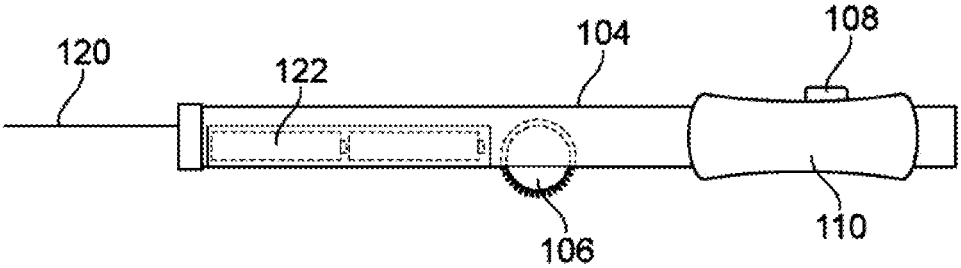
FIG. 5
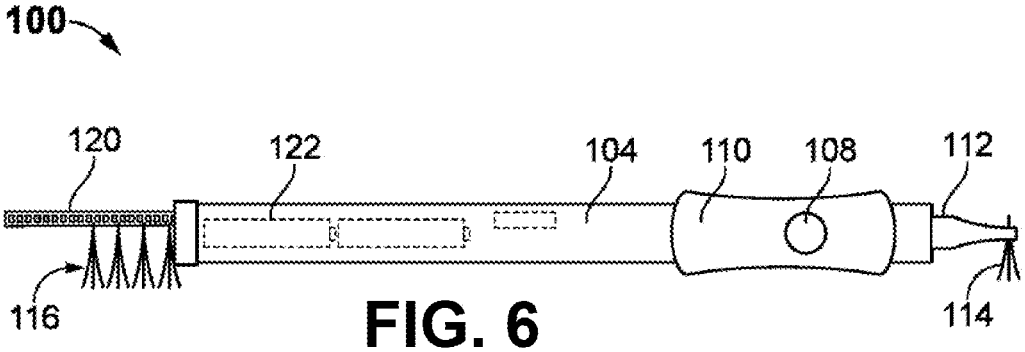
FIG. 6
FIG. 7
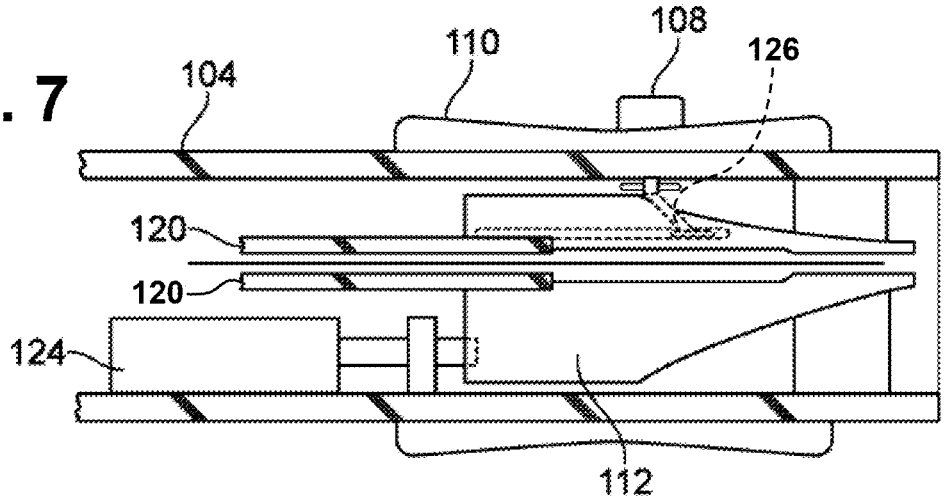

FALSE EYELASH DISPENSING DEVICE

RELATED APPLICATIONS

This is a continuation application and so claims the benefit pursuant to 35 U.S.C. § 120 of a prior filed and co-pending U.S. non-provisional patent application Ser. No. 17/716,987, filed on Apr. 8, 2022, which itself is a continuation-in-part of U.S. non-provisional patent application Ser. No. 16/778,863, filed on Jan. 31, 2020. The contents of the aforementioned applications are incorporated herein by reference.

BACKGROUND

The subject of this patent application relates generally to false eyelashes, and more particularly to a false eyelash dispensing device configured for more easily and uniformly applying an at least one false eyelash to an eyelid or eyelash of a user.

Applicant hereby incorporates herein by reference any and all patents and published patent applications cited or referred to in this application.

By way of background, false eyelashes are traditionally engaged with the existing lashes of a person to enhance or exaggerate the appearance of natural eyelashes. Throughout history, long and/or fuller eyelashes have always been desirable as a beauty enhancement, usually for women but not exclusively. As a person ages, their eyelashes tend to get shorter and sparser. Eyelash length and fullness is a sign of youth and vigor, so it is natural for some people to desire to look younger and reduce the effects of aging. In many cases, it is not only the desire to look younger but to heighten and emphasize the eyes.

The process of applying false eyelashes can be a very tedious task. False eyelashes must be applied with extreme care—both because they are very small and delicate, and because they are traditionally applied using tweezers (which can be sharp and potentially dangerous to the user's eyes). Additionally, each false eyelash traditionally had to be removed from its container one at a time, and an appropriate adhesive applied before placing onto the user's natural eyelashes.

Currently, there are many existing devices or tools available on the market that are designed to assist with the application of false eyelashes. Cosmetologists and salon workers are carefully handling each eyelash one at a time from a container or box and they require a lot of practice for handling the existing devices or tools. The time and effort used to apply false eyelashes are considerable, and for someone who has to make multiple applications over the course of a day, it could become a wearying task.

Therefore, there is a need for a novel type of cosmetic applicator or device for more easily and uniformly applying false eyelashes to a user's eyelids or natural eyelashes. Further, there is also a need to provide a device to temporarily store the false eyelashes, prior to application, which could readily release from the device after positioning on the eyelid/eyelash safely without any effort. Aspects of the present invention fulfill these needs and provide further related advantages as described in the following summary.

It should be noted that the above background description includes information that may be useful in understanding aspects of the present invention. It is not an admission that any of the information provided herein is prior art or relevant to the presently claimed invention, or that any publication specifically or implicitly referenced is prior art.

SUMMARY

Aspects of the present invention teach certain benefits in construction and use which give rise to the exemplary advantages described below.

The present invention solves the problems described above by providing a false eyelash dispensing device configured for more easily and uniformly applying an at least one false eyelash to an eyelid or natural eyelash of a user (hereinafter collectively referred to as the user's eyelid for simplicity purposes). In at least one embodiment, an at least one elongate lash belt removably supports an at least one lash strip thereon, each of the at least one lash strip comprising an at least one false eyelash oriented in a direction substantially transverse to the lash belt. An elongate housing is sized and configured for receiving the at least one lash belt therewithin. The housing includes an entry opening provided by an entry end of the housing and configured for receiving the at least one lash belt therethrough, along with an exit opening provided by an opposing exit end of the housing. A lash belt carrier is positioned within the housing and includes a substantially C-shaped channel positioned and configured for slidably receiving the at least one lash belt therewithin, such that the at least one false eyelash of the at least one lash strip of the at least one lash belt is oriented in a direction substantially transverse to the housing, each of a first end and a second end of the channel positioned proximal the entry opening. The last belt carrier also includes an at least one gear in mechanical communication with the at least one lash belt and configured for selectively advancing the at least one lash belt and, in turn, the at least one lash strip longitudinally through the channel, from the first end of the channel toward the second end of the channel. An eyelash holder is positioned laterally adjacent to the channel, directly in front of the exit opening, and comprises a first half and an opposing second half configured for selectively moving in and out of abutting contact with the first half, the eyelash holder configured for selectively moving between one of a retracted position—wherein the eyelash holder is positioned substantially within the housing proximal the exit opening—and an extended position—wherein the eyelash holder extends a distance through the exit opening. A spring-biased button is positioned on an outer surface of the housing. Upon the button being manually depressed after the at least one lash belt is selectively advanced via the at least one gear so as to position a one of the at least one lash strip directly in front of the exit opening, substantially flanked by the first and second halves of the eyelash holder, the button is configured for moving the first and second halves of the eyelash holder into abutting contact with one another, thereby temporarily sandwiching said lash strip therebetween, the eyelash holder engaged laterally across said lash strip such that the at least one false eyelash of said lash strip remains oriented in a direction substantially transverse to the housing, and moving the eyelash holder from the retracted position to the extended position, thereby detaching said lash strip from the lash belt and moving said lash strip through the exit opening so that said lash strip may be subsequently applied to the user's eyelid while engaged with the eyelash holder.

In at least one embodiment, a method for applying an at least one false eyelash to an eyelid of a user using the false eyelash dispensing device includes the steps of inserting a lash belt into the channel of the lash belt carrier; selectively advancing the lash belt within the channel via the at least one gear so as to position a one of the at least one lash strip directly in front of the exit opening of the housing, substantially flanked by the first and second halves of the eyelash holder; manually depressing the button so as to automatically: move the first and second halves of the eyelash holder into abutting contact with one another, thereby temporarily sandwiching said lash strip therebetween, the eyelash holder engaged laterally across said lash strip such that the at least one false eyelash of said lash strip remains oriented in a direction substantially transverse to the housing; and move the eyelash holder from the retracted position to the extended position, thereby detaching said lash strip from the lash belt and moving said lash strip through the exit opening; dipping a free end of said lash strip in an adhesive while said lash strip is engaged with the eyelash holder; applying said lash strip to the user's eyelid while said lash strip is engaged with the eyelash holder; and releasing the button so as to disengage said lash strip from the eyelash holder and move the eyelash holder back into the retracted position.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings:

FIG. 4 is a top plan view of an exemplary false eyelash strip, in accordance with at least one embodiment;

FIG. 5 is a further side view of the device, in accordance with at least one embodiment;

FIG. 6 is a further top plan view of the device, in accordance with at least one embodiment;

FIG. 7 is a side sectional view of the device, in accordance with at least one embodiment;

The above described drawing figures illustrate aspects of the invention in at least one of its exemplary embodiments, which are further defined in detail in the following description. Features, elements, and aspects of the invention that are referenced by the same numerals in different figures represent the same, equivalent, or similar features, elements, or aspects, in accordance with one or more embodiments.

DETAILED DESCRIPTION

Figure 1:
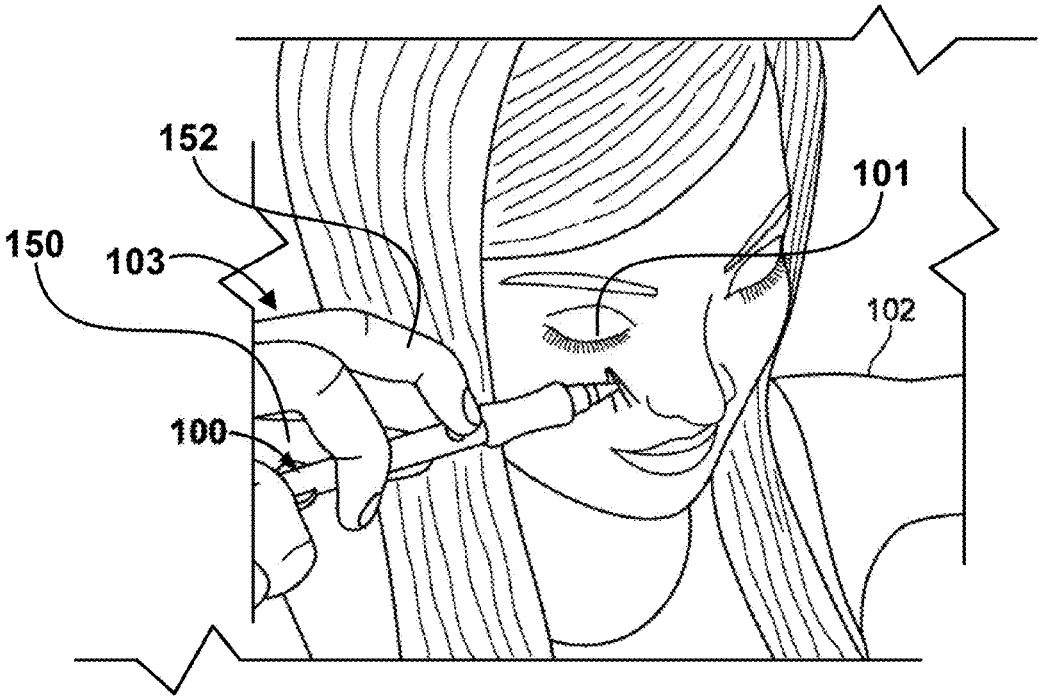
FIG. 1 is a partial perspective view of an exemplary false eyelash dispensing device in use, in accordance with at least one embodiment.

Turning now to FIG. 1, there is shown a perspective view of an exemplary embodiment of a false eyelash dispensing device 100 for applying an at least one false eyelash 114 to an eyelid 101 of a user 102. In at least one embodiment, the device 100 is an innovative beauty product that has been designed to provide the optimum method for eyelash grafting and enhances the beauty of the eyes. The device 100 has the ability to quickly and professionally apply false eyelashes 114 by the user 102. In at least one embodiment, the device 100 allows the stylist to easily select, index, glue, and place individual groups of lashes on user's eyelids 101. This single bunch placement provides a more elegant and natural look than the complete lashes mounted on a flexible band. The device 100 could easily be cleaned and made ready for the next application. The device 100 is easy to grip and handle for the stylist or user 102 using a single hand 103.

In at least one embodiment, as illustrated best in FIGS. 4 and 8A-8D, the device 100 provides an at least one elongate lash belt 120 removably supporting an at least one lash strip 116 thereon, with each of the at least one lash strip 116 comprising an at least one false eyelash 114 oriented in a direction substantially transverse to the lash belt 120. In at least one embodiment, each of the at least one lash strip 116 is adhered to the lash belt 120 in a spaced apart fashion using glue or the like; however, in further embodiments, any other mechanism, technique or substance, now known or later developed, capable of affixing the at least one lash strip 116 to the lash belt 120 (either permanently or temporarily) may be substituted. In at least one embodiment, the lash belt 120 is a thin molded plastic sprocket belt; however, in further embodiments, the lash belt 120 may be constructed out of any other material (or combination of materials) now known or later developed, so long as the device 100 is capable of substantially carrying out the functionality described herein. It should also be noted that the specific size, shape and dimensions of the lash belt 120 depicted in the drawings is merely exemplary and being shown for illustrative purposes only. As such, in further embodiments, the lash belt 120 may take on any other sizes, shapes and/or dimensions now known or later developed, so long as the device 100 is capable of substantially carrying out the functionality described herein. Similarly, each of the at least one lash strip 116 may also take on any other sizes, shapes, dimensions and/or quantities of false eyelashes 114 now known or later developed, so long as the device 100 is capable of substantially carrying out the functionality described herein. Thus, in further embodiments, as illustrated in FIGS. 8A-8D, the false eyelashes 114 could be supplied in different sizes and/or thicknesses, including wispy, medium, or full weights. Additionally, in at least one embodiment, the false eyelashes 114 are constructed out of virgin human hair, Remy human hair, silk lashes, mink, or faux mink hair. In at least one embodiment, the lash belt 120 could be supplied in one of almost any vibrant colors, such that a color code could be used for each type and thickness of false eyelashes 114. In at least one embodiment, each eyelash strip 116 comprises a plurality of false eyelashes 114; however, in at least one alternate embodiment, each eyelash strip 116 comprises a single false eyelash 114.

Figure 2A:
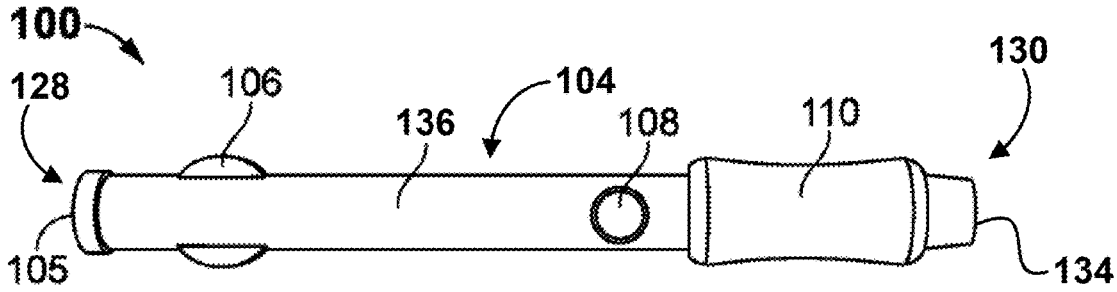
FIG. 2A is a top plan view thereof, in accordance with at least one embodiment.
Figure 2B:
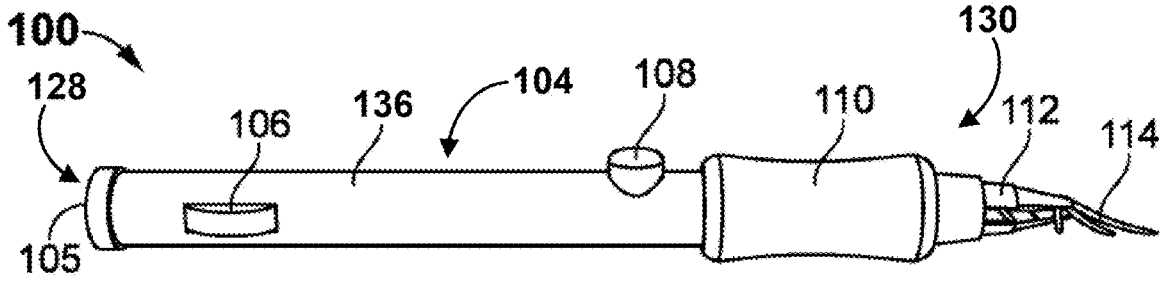
FIG. 2B is a side view thereof, in accordance with at least one embodiment.

In at least one embodiment, as illustrated in FIGS. 2A and 2B, the device 100 further provides an elongate housing 104 sized and configured for removably receiving the at least one lash belt 120 therewithin. In at least one alternate embodiment, the device 100 is disposable, and the lash belt 120 is permanently positioned within the housing 104. In at least one embodiment, the housing 104 provides an entry end 128 and an opposing exit end 130. In at least one such embodiment, the entry end 128 provides an entry opening 105 configured for receiving the at least one lash belt 120 therethrough, as illustrated in FIGS. 5 and 6. Additionally, in at least one embodiment, the exit end 130 provides an exit opening 134, as discussed further below. In at least one embodiment, the housing 104 (along with the other components positioned on or within the housing 104 as described herein) is injection molded from polycarbonate plastic, which is very durable, is highly resistant to drop shocks, and is highly resistant to household and salon chemicals. Additionally, in at least one embodiment, an outer surface 136 of the housing 104 provides a resilient, ergonomic grip portion 110 positioned proximal the exit end 130 of the housing 104 and configured to provide a tight grip to the user's hand 103 while holding the device 100. However, in further embodiments, the housing 104 and other components described herein may be constructed out of any other materials (or combinations of materials) now known or later developed, so long as the device 100 is capable of substantially carrying out the functionality described herein. Similarly, it should be noted that the specific sizes, shapes and dimensions of the housing 104 depicted in the drawings are merely exemplary and being shown for illustrative purposes only. As such, in further embodiments, the 5 housing 104 (along with all other components shown and described herein) may take on any other sizes, shapes and/or dimensions now known or later developed, so long as the device 100 is capable of substantially carrying out the functionality described herein.

Figure 3A:
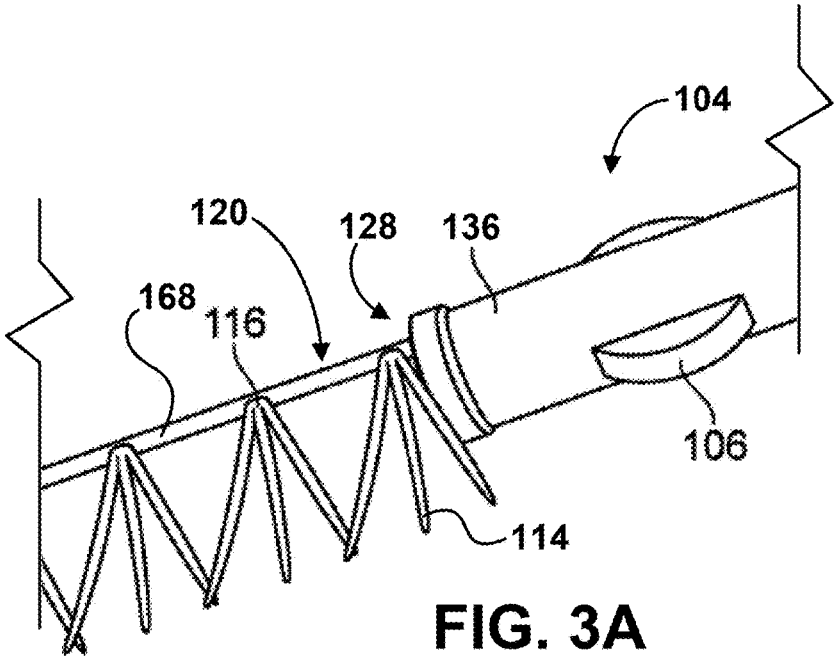
FIG. 3A is partial perspective view of an exemplary false eyelash strip being inserted into the device, in accordance with at least one embodiment.
Figure 10:
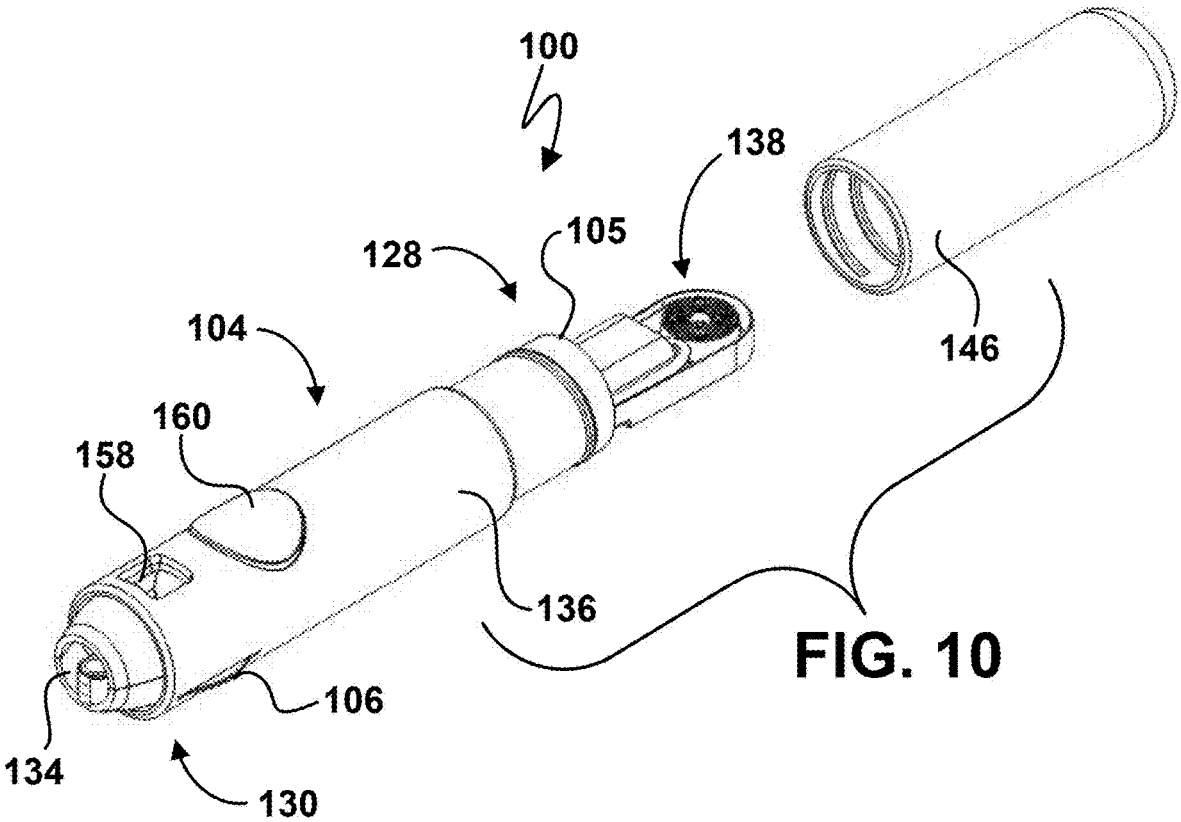
FIG. 10 is a partially exploded view thereof, in accordance with at least one embodiment.
Figure 11:
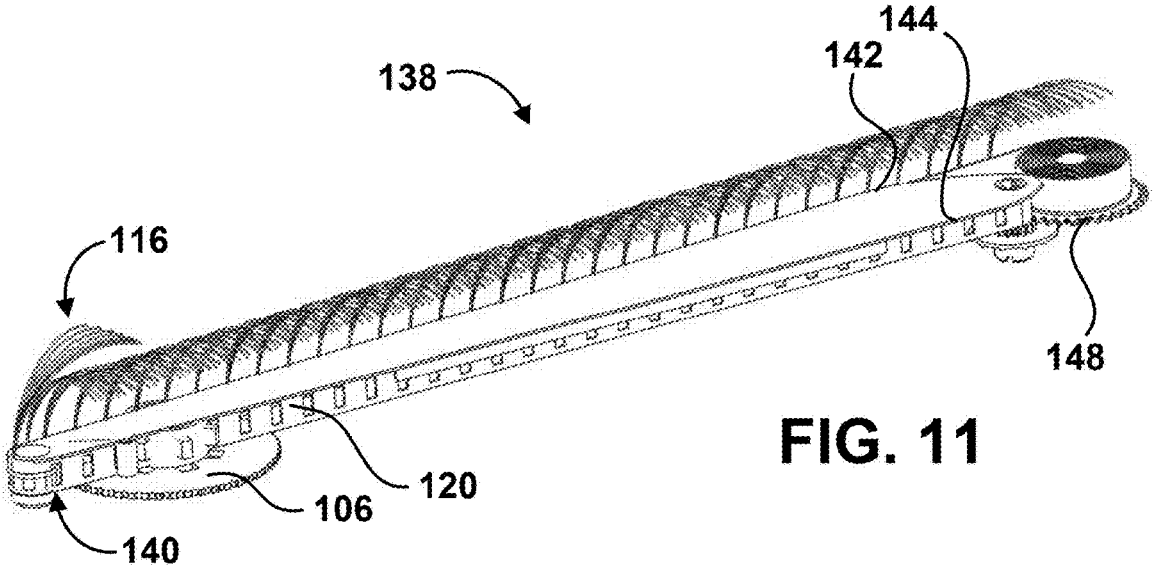
FIGS. 11 and 12 are perspective views of an exemplary lash belt carrier of the device, in accordance with at least one embodiment.
Figure 12:
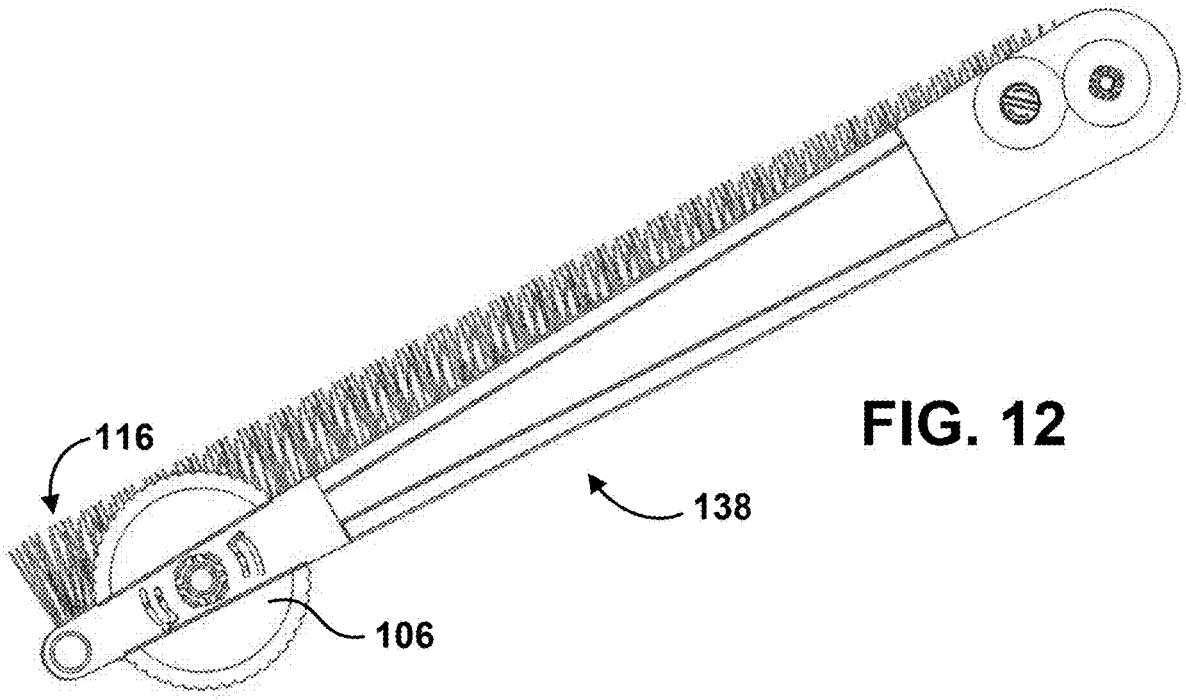

In at least one embodiment, as illustrated in FIGS. 10-12, the housing 104 provides a lash belt carrier 138 positioned within the housing 104 and configured for moving the lash belt 120 from the entry end 128 of the housing 104 to the exit end 130 of the housing 104. In at least one embodiment, the lash belt carrier 138 provides a substantially C-shaped channel 140 positioned and configured for slidably receiving the at least one lash belt 120 therewithin, such that the at least one false eyelash 114 of the at least one lash strip 116 of the at least one lash belt 120 is oriented in a direction substantially transverse to the housing 104, as illustrated in FIG. 6. In at least one embodiment, each of a first end 142 and a second end 144 of the channel 140 is positioned proximal to the entry opening 105 of the housing 104. Accordingly, in at least one such embodiment, as illustrated in FIGS. 3A and 6, the lash belt 120 is capable of being inserted through the entry end 128 of the housing 104 and into the first end 142 of the channel 140. In at least one alternate embodiment, as illustrated in FIGS. 10-12, the lash belt carrier 138 is selectively removable from the housing 104, through the entry opening 105 of the housing 104, such that the entire lash belt carrier 138 may be removed in order to insert the lash belt 120 into the channel 140, at which point the lash belt carrier 138 may be reinserted into the housing 104 through the entry opening 105. In at least one such embodiment, the lash belt 120 is a continuous loop. Additionally, in at least one such embodiment, as illustrated in FIG. 10, the entry end 128 of the housing 104 provides a removably engageable end cap 146 configured for covering the entry opening 105. In at least one still further embodiment, the lash belt 120 and lash belt carrier 138 are manufactured as a disposable unit, such that the lash belt 120 comes pre-installed on the lash belt carrier 138, with the lash belt 120 and lash belt carrier 138 being removed, discarded and replaced upon all lash strips 116 on the lash belt 120 being used.

Figure 3B:
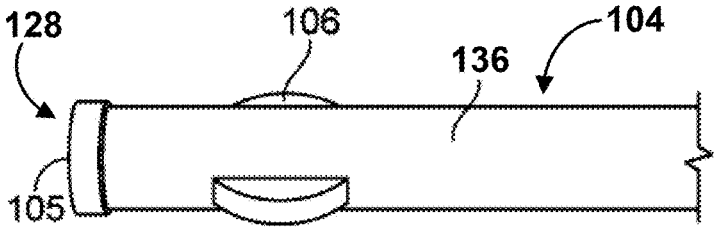
FIG. 3B is a partial perspective view of an entry end of the device, in accordance with at least one embodiment.

With continued reference to FIGS. 10-12, in at least one embodiment, the lash belt carrier 138 further provides an at least one gear 148 in mechanical communication with the lash belt 120 and configured for selectively advancing the at least one lash belt 120 and, in turn, the at least one lash strip 116 longitudinally through the channel 140, from the first end 142 of the channel 140 toward the second end 144 of the channel 140. In at least one embodiment, the at least one gear 148 is further in mechanical communication with a scrolling dial 106 provided by the housing 104 and configured for being manually rotated in order to actuate the at least one gear 148. In at least one such embodiment, the scrolling dial 106 is positioned proximal to the exit end 130 of the housing 104 so as to be easily manipulated by a thumb 150 or finger 152 of the user 102 while the device 100 is grasped in one hand 103, thereby allowing the device 100 to be used entirely with one hand 103. In at least one alternate embodiment, as illustrated in FIG. 3B, the scrolling dial 106 is positioned proximal to the entry end 128 of the housing 104. In further alternate embodiments, the scrolling dial 106 may be positioned elsewhere relative to the housing 104. In still further alternate embodiments, the scrolling dial 106 may be omitted and replaced by any other manual or automated mechanism (or combination of mechanisms), now known or later developed, capable of selectively actuating the at least one gear 148. In at least one still further embodiment, the scrolling dial 106 is ratcheted, so as to allow rotation in only a single direction—namely, moving the lash belt 120 from the first end 142 of the channel 140 toward the second end 144 of the channel 140.

Figure 9:
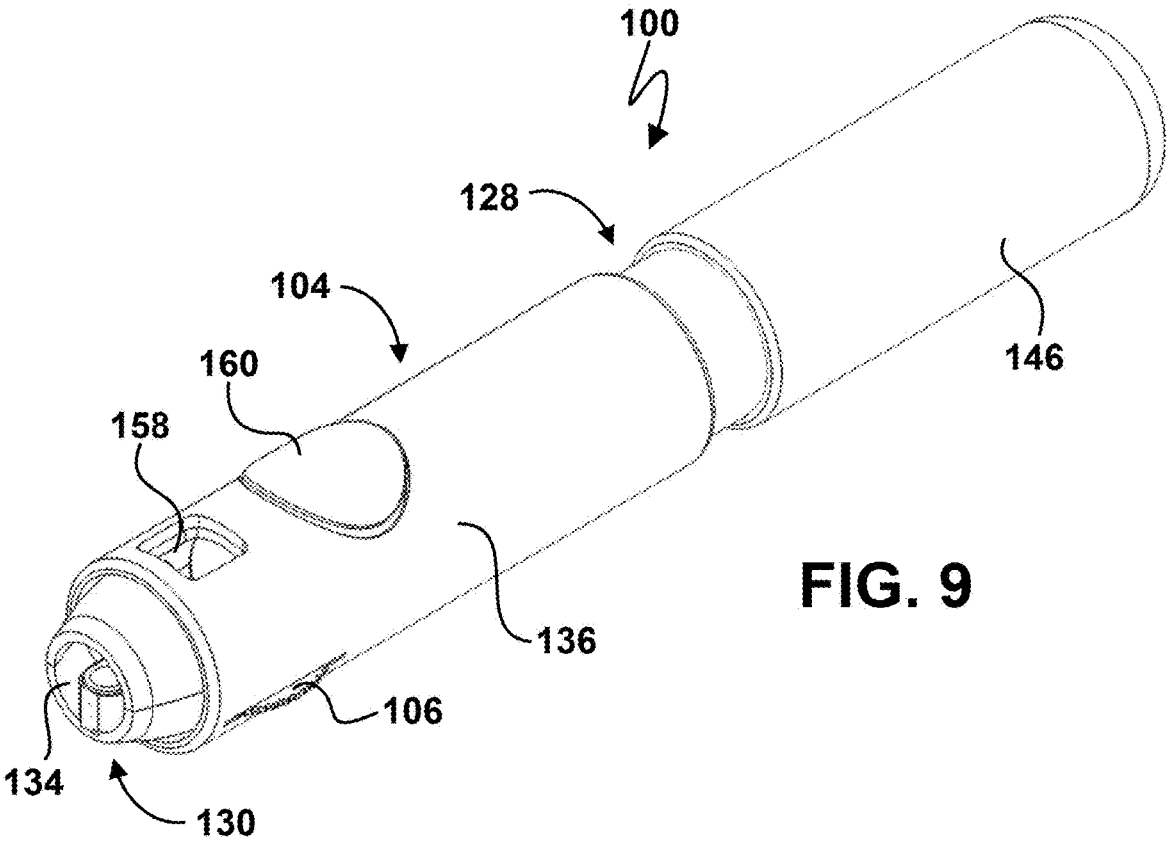
FIG. 9 is a perspective view of a further exemplary false eyelash dispensing device, in accordance with at least one embodiment.

In at least one embodiment, the housing 104 further provides an eyelash holder 112 positioned laterally adjacent to the channel 140. In at least one embodiment, the eyelash holder 112 comprises a first half 154 and an opposing second half 156 configured for selectively moving in and out of abutting contact with the first half 154. Additionally, the channel 140 is positioned relative to the eyelash holder 112 such that, as the at least one lash strip 116 moves through the channel 140 (via the lash belt 120) to a position directly in front of the exit opening 134 of the housing 104, the lash strip 116 is substantially flanked by the first and second halves 154 and 156 of the eyelash holder 112. In at least one embodiment, as best illustrated in FIGS. 9 and 10, the housing 104 provides a positioning window 158 proximal to the entry opening 105 and adjacent to the first and second halves 154 and 156 of the eyelash holder 112. The positioning window 158 provides visual access into the housing 104 so that the user 102 may manually advance the next lash strip 116 on the lash belt 120 (via the at least one gear 148) through the channel 140 until said lash strip 116 is positioned directly in front of the exit opening 134 of the housing 104. In at least one embodiment, the first and second halves 154 and 156 of the eyelash holder 112 are constructed out of (or at least coated with) a high-friction material with a relatively high durometer hardness, such as silicone or rubber for example. However, in further embodiments, the first and second halves 154 and 156 of the eyelash holder 112 may be constructed out of any other materials (or combinations of materials) now known or later developed, so long as the device 100 is capable of substantially carrying out the functionality described herein.

Figure 3C:
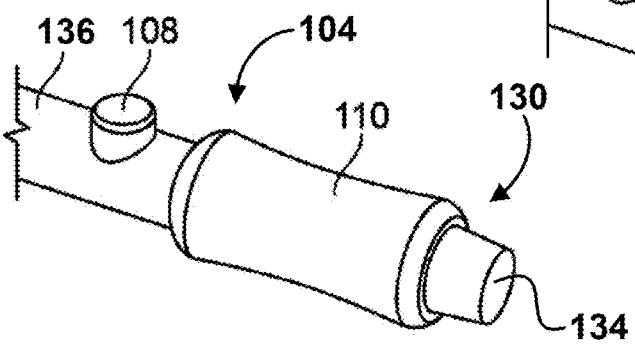
FIGS. 3C and 3D are partial perspective views of an exit end of the device, in accordance with at least one embodiment.
Figure 3D:
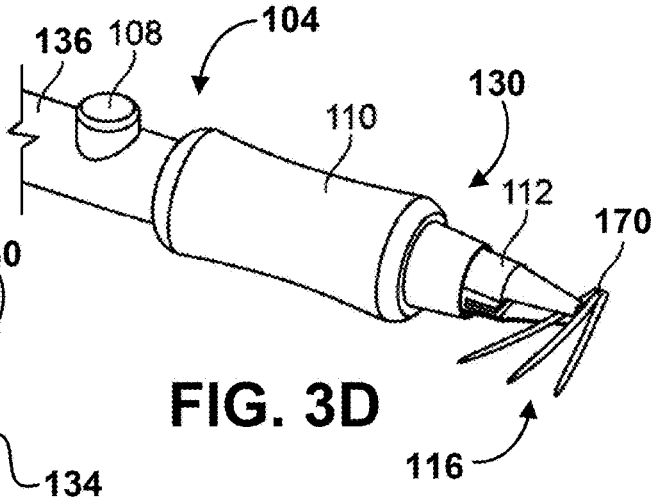
Figure 8A:
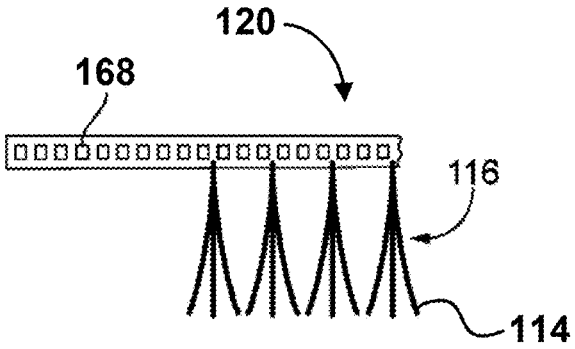
FIGS. 8A-8D are top plan views of further exemplary false eyelash strips, in accordance with at least one embodiment.
Figure 8B:
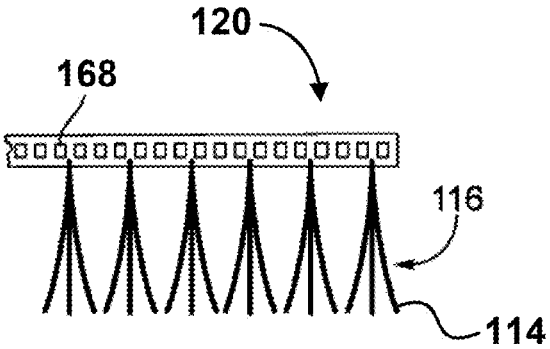
Figure 8C:
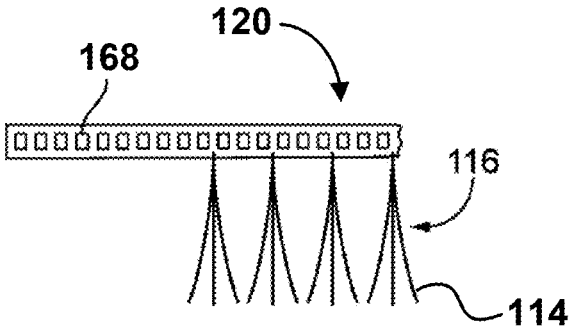
Figure 8D:
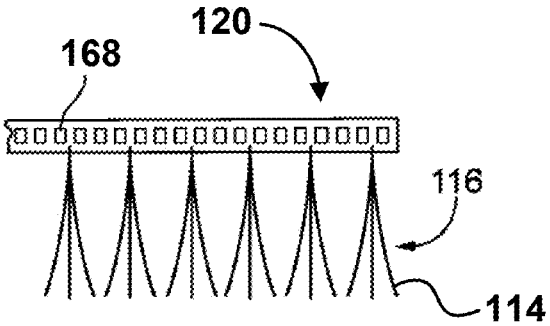
Figure 13:
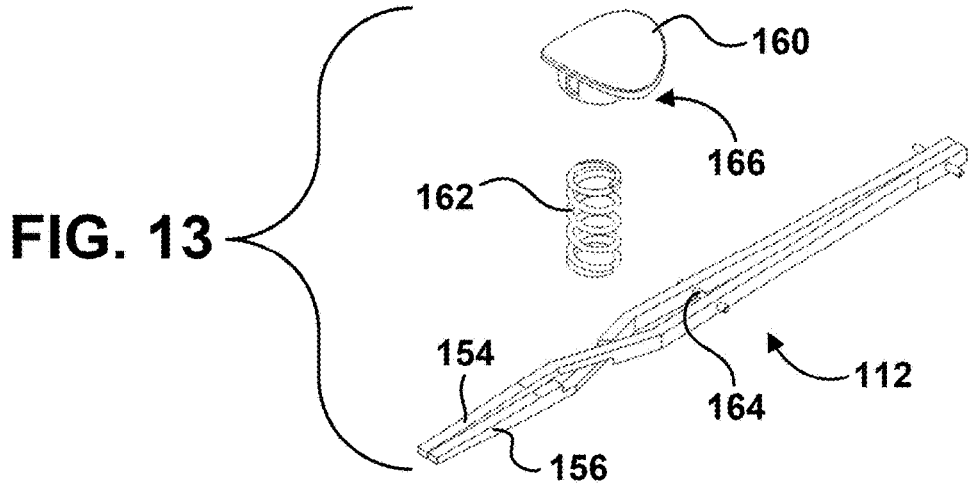
FIG. 13 is an exploded view of an exemplary eyelash holder of the device, in accordance with at least one embodiment.
Figure 14:
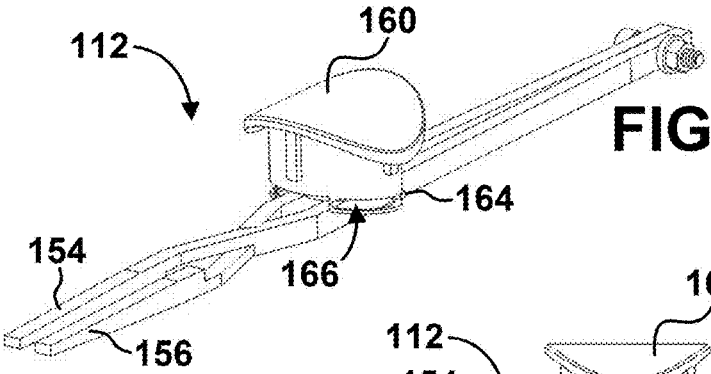
FIG. 14 is a perspective view of an exemplary eyelash holder of the device, illustrating a button of the device in an undepressed state, in accordance with at least one embodiment.
Figure 14A:
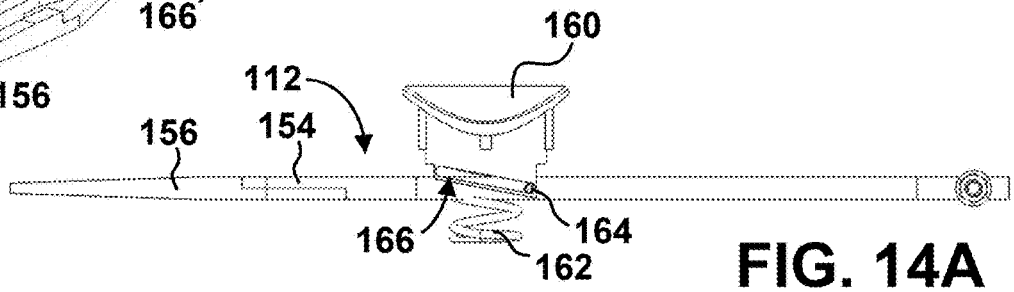
FIG. 14A is a side view thereof, in accordance with at least one embodiment.
Figure 15:
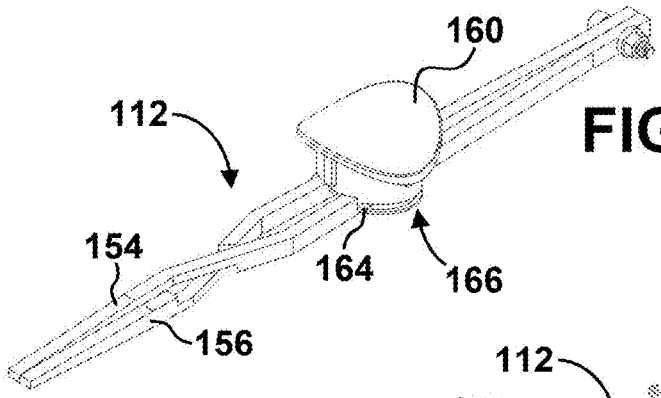
FIG. 15 is a perspective view of an exemplary eyelash holder of the device, illustrating the button of the device in a depressed state, in accordance with at least one embodiment.
Figure 15A:
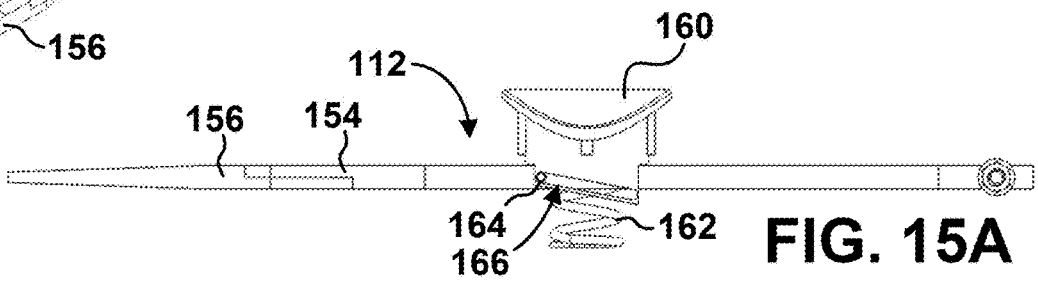
FIG. 15A is a side view thereof, in accordance with at least one embodiment.
Figure 16:
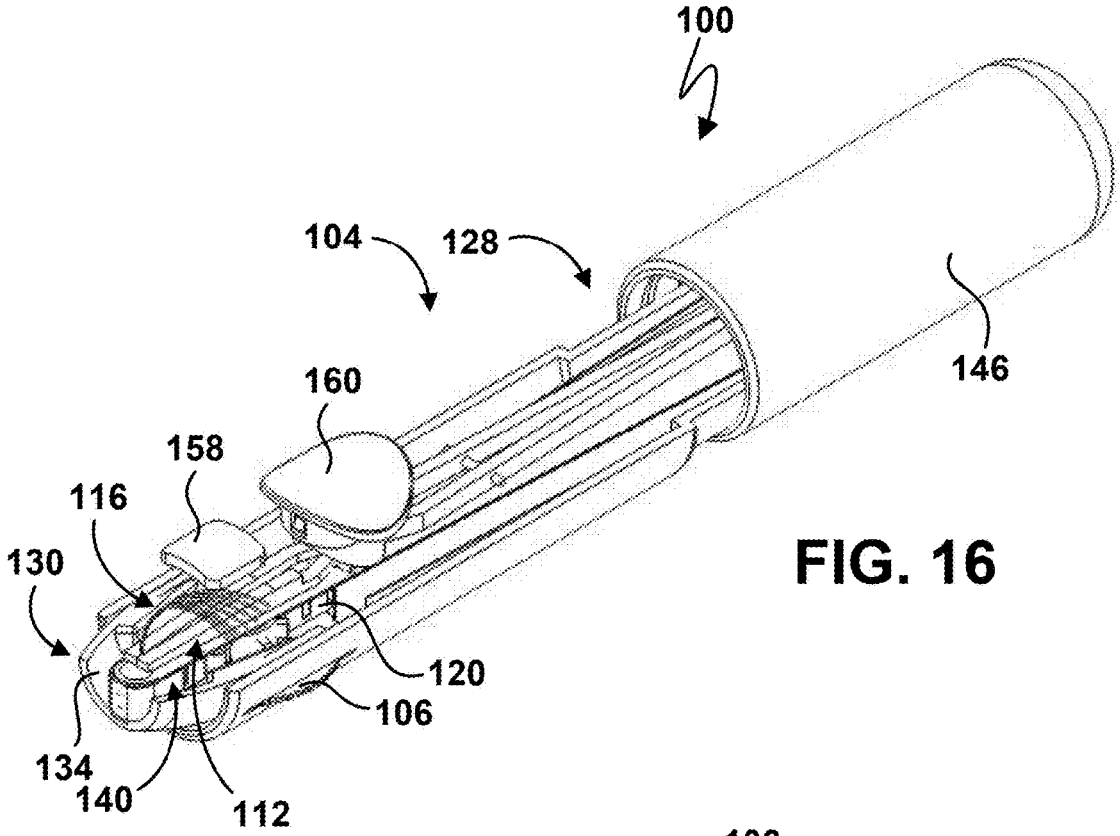
FIG. 16 is a further perspective view of the device, showing the exemplary eyelash holder in the retracted position, in accordance with at least one embodiment.
Figure 17:
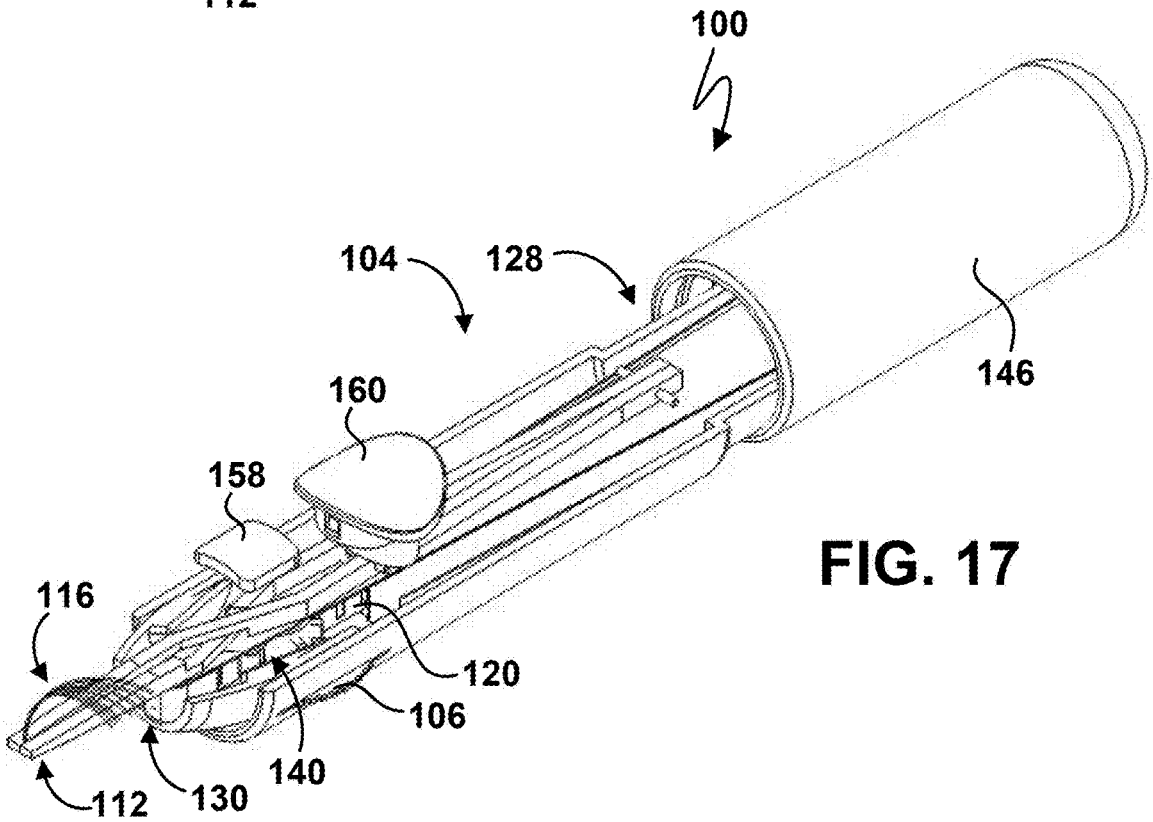
FIG. 17 is a still further perspective view of the device, showing the exemplary eyelash holder in the extended position, in accordance with at least one embodiment.

In at least one embodiment, the eyelash holder 112 is further configured for selectively moving between one of a retracted position—wherein the eyelash holder 112 is positioned substantially within the housing 104 proximal the exit opening 134 (FIGS. 2A, 3C and 16)—and an extended position—wherein the eyelash holder 112 extends a distance through the exit opening 134 (FIGS. 2B, 3D and 17). In at least one such embodiment, the housing 104 provides a spring-biased button 160 positioned on an outer surface 136 of the housing 104 and in mechanical communication with the eyelash holder 112. In at least one such embodiment, the button 160 is positioned proximal to the exit end 130 of the housing 104 so as to be easily manipulated by a thumb 150 or finger 152 of the user 102 while the device 100 is grasped in one hand 103, thereby allowing the device 100 to be used entirely with one hand 103. In at least one alternate embodiment, the button 160 may be positioned elsewhere relative to the housing 104. In at least one embodiment, as illustrated in FIGS. 13-15A, upon the button 160 being manually depressed (FIGS. 15 and 15A), the button 160 causes the first and second halves 154 and 156 of the eyelash holder 112 to move into abutting contact with one another; and upon the button 160 being subsequently released (FIGS. 14 and 14A), a spring 162 causes the first and second halves 154 and 156 of the eyelash holder 112 to move out of abutting contact with one another. In at least one embodiment, as best illustrated in FIG. 13, the eyelash holder 112 provides a laterally oriented pin 164 that slidably extends between the first and second halves 154 and 156 and rides within a cam slot 166 provided by the button 160. Accordingly, as the button 160 is depressed, the pin 164 travels along the cam slot 166 which, in turn, causes the first and second halves 154 and 156 of the eyelash holder 112 to move into abutting contact with one another, while also moving the eyelash holder 112 into the extended position; and upon the button 160 being subsequently released, the pin 164 travels in an opposite direction along the cam slot 166 which, in turn, causes the first and second halves 154 and 156 of the eyelash holder 112 to move out of abutting contact with one another, while also moving the eyelash holder 112 into the retracted position. In at least one such embodiment, the direction of movement of the eyelash holder 112 from the retracted position to the extended position is substantially orthogonal to a lash surface 168 of the lash belt 120 on which the at least one lash strip 116 is engaged, thereby assisting in the detachment of the sandwiched lash strip 116 from the lash belt 120 as the eyelash holder 112 moves into the extended position.

Thus, during use of the device 100, in at least one embodiment, after the at least one gear 148 selectively advances the lash belt 120 so as to position a one of the at least one lash strip 116 directly in front of the exit opening 134 of the housing 104, the button 160 is manually depressed so as to move the first and second halves 154 and 156 of the eyelash holder 112 to move into abutting contact with one another-thereby temporarily sandwiching the lash strip 116 therebetween (the eyelash holder 112 engaged laterally across said lash strip 116 such that the at least one false eyelash 114 of said lash strip 116 remains oriented in a direction substantially transverse to the housing 104)—while simultaneously moving the eyelash holder 112 into the extended position—thereby separating said lash strip 116 from the lash belt 120 and moving the lash strip 116 through the exit opening 134 of the housing 104, where the lash strip 116 may then be applied to the user's eyelid 101 while the lash strip 116 is still engaged with the eyelash holder 112. Once the lash strip 116 has been applied to the user's eyelid 101, the button 160 may be released, thereby disengaging the lash strip 116 from the eyelash holder 112 and moving the eyelash holder 112 back into the retracted position. Meanwhile, the remaining lash strips 116 on the lash belt 120 are retained safely within the housing 104 until they are eventually applied to the user's eyelid 101 through the process described above. In at least one embodiment, where the lash belt 120 is removably inserted within the housing 104, once all lash strips 116 have been removed from the lash belt 120 and applied to the user's eyelid 101, the lash belt 120 may be removed and replaced.

In at least one embodiment, while the lash strip 116 is still engaged with the eyelash holder 112, a free end 170 of the lash strip 116 may be dipped in an adhesive—such as an eyelash glue, for example—prior to being applied to the user's eyelid 101, thereby creating a more secure engagement between the lash strip 116 and the user's eyelid 101. In at least one such embodiment, the adhesive could be supplied with the device 100. Additionally, in at least one embodiment, the adhesive could be supplied in two formulations such as, but not limited to, a salicylic acid base and an ethylhexyl acrylate base. In at least one embodiment, the adhesive may also be gluten free, cruelty free, BPS free, sulfate free, and vegan certified.

In at least one alternate embodiment, as illustrated in FIG. 7, a solenoid 124 is positioned within the housing 104 and configured for selectively moving the eyelash holder 112 between the retracted position and extended position. In at least one such embodiment, the button 160 is further configured for actuating the solenoid 124 so as to move the eyelash holder 112 from the retracted position to the extended position, thereby moving the separated lash strip 116 through the exit opening 134 so that the separated lash strip 116 may be subsequently applied to the user's eyelid 101 while engaged with the eyelash holder 112. In still further embodiments, any other manual or automated mechanism (or combinations of mechanisms) now known or later developed, capable of selectively moving the first and second halves 154 and 156 of the eyelash holder 112 into and out of abutting contact with one another, and also selectively moving the eyelash holder 112 between the extended and retracted positions, may be substituted. In at least one embodiment, the device 100 could be operated with batteries 122. In at least one such embodiment, the batteries 122 could also provide power for inexpensive electronics within the device 100. In at least one embodiment, a printed circuit board (PCB) is fabricated to the final assembler's requirements in a world-class contract electronic assembler facility. The standard thickness, double-sided FR4 circuit board material is populated with surface mounted components where possible. Any through-hole devices are inserted after the surface mounted assembly, soldering, and cleaning. The microprocessor firmware is pre-programmed into the chip and provides the slight time delays required to operate the solenoid properly. The circuit board is designed to have all the components oriented so the switch action is performed effortlessly. After assembly, the PCBs are protected with a moisture adsorption preventive conformal coating.

In at least one embodiment, as also illustrated in FIG. 7, the eyelash holder 112 further provides a cutter 126 positioned and configured for selectively cutting the at least one lash strip 116, when said lash strip 116 is sandwiched between the first and second halves 154 and 156 of the eyelash holder 112, so as to separate said lash strip 116 from the lash belt 120.

Aspects of the present specification may also be described as the following embodiments:

1. A false eyelash dispensing device for applying an at least one false eyelash to an eyelid of a user, the device comprising: an at least one elongate lash belt removably supporting an at least one lash strip thereon, each of the at least one lash strip comprising an at least one false eyelash oriented in a direction substantially transverse to the lash belt; an elongate housing sized and configured for receiving the at least one lash belt therewithin, the housing comprising: an entry opening provided by an entry end of the housing and configured for receiving the at least one lash belt therethrough; an exit opening provided by an opposing exit end of the housing; a lash belt carrier positioned within the housing and comprising: a substantially C-shaped channel positioned and configured for slidably receiving the at least one lash belt therewithin, such that the at least one false eyelash of the at least one lash strip of the at least one lash belt is oriented in a direction substantially transverse to the housing, each of a first end and a second end of the channel positioned proximal the entry opening; and an at least one gear in mechanical communication with the at least one lash belt and configured for selectively advancing the at least one lash belt and, in turn, the at least one lash strip longitudinally through the channel, from the first end of the channel toward the second end of the channel; an eyelash holder positioned laterally adjacent to the channel, directly in front of the exit opening, and comprising a first half and an opposing second half configured for selectively moving in and out of abutting contact with the first half, the eyelash holder configured for selectively moving between one of a retracted position—wherein the eyelash holder is positioned substantially within the housing proximal the exit opening—and an extended position—wherein the eyelash holder extends a distance through the exit opening; and a spring-biased button positioned on an outer surface of the housing, wherein upon the button being manually depressed after the at least one lash belt is selectively advanced via the at least one gear so as to position a one of the at least one lash strip directly in front of the exit opening, substantially flanked by the first and second halves of the eyelash holder, the button is configured for: moving the first and second halves of the eyelash holder into abutting contact with one another, thereby temporarily sandwiching said lash strip therebetween, the eyelash holder engaged laterally across said lash strip such that the at least one false eyelash of said lash strip remains oriented in a direction substantially transverse to the housing; and moving the eyelash holder from the retracted position to the extended position, thereby detaching said lash strip from the lash belt and moving said lash strip through the exit opening so that said lash strip may be subsequently applied to the user's eyelid while engaged with the eyelash holder.
2. The false eyelash dispensing device according to embodiment 1, wherein: the lash belt carrier is removably positionable within the housing; and the entry end of the housing is sized and configured for allowing the lash belt carrier to be inserted therethrough.
3. The false eyelash dispensing device according to embodiments 1-2, wherein the housing further comprises an end cap removably engageable with the entry end of the housing and configured for covering the entry opening.
4. The false eyelash dispensing device according to embodiments 1-3, wherein the at least one gear is further in mechanical communication with a scrolling dial provided by the housing and configured for being manually rotated in order to actuate the at least one gear.
5. The false eyelash dispensing device according to embodiments 1-4, wherein the scrolling dial is a wheel.
6. The false eyelash dispensing device according to embodiments 1-5, wherein the scrolling dial is positioned proximal to the exit end of the housing.
7. The false eyelash dispensing device according to embodiments 1-6, wherein the scrolling dial is ratcheted.
8. The false eyelash dispensing device according to embodiments 1-7, wherein the housing is formed from polycarbonate plastic.
9. The false eyelash dispensing device according to embodiments 1-8, wherein the first and second halves of the eyelash holder are constructed out of or otherwise coated with a high-friction material with a relatively high durometer hardness.
10. The false eyelash dispensing device according to embodiments 1-9, wherein the housing further comprises a positioning window positioned proximal to the entry opening and adjacent to the first and second halves of the eyelash holder, the positioning window configured for providing visual access into the housing.
11. The false eyelash dispensing device according to embodiments 1-10, wherein the button is positioned proximal to the exit end of the housing.
12. The false eyelash dispensing device according to embodiments 1-11, wherein: the eyelash holder provides a laterally oriented pin that slidably extends between the first and second halves of the eyelash holder and rides within a cam slot provided by the button; whereby, as the button is depressed, the pin travels along the cam slot which, in turn, causes the first and second halves of the eyelash holder to move into abutting contact with one another, while also moving the eyelash holder into the extended position; and whereby, upon the button being subsequently released, the pin travels in an opposite direction along the cam slot which, in turn, causes the first and second halves of the eyelash holder to move out of abutting contact with one another, while also moving the eyelash holder into the retracted position.
13. The false eyelash dispensing device according to embodiments 1-12, wherein the housing further comprises a solenoid positioned within the housing and configured for selectively moving the eyelash holder between the retracted position and extended position.

14. The false eyelash dispensing device according to embodiments 1-13, wherein the eyelash holder further provides a cutter positioned and configured for selectively cutting the at least one lash strip, when said lash strip is sandwiched between the first and second halves of the eyelash holder, so as to detach said lash strip from the corresponding at least one lash belt.

15. The false eyelash dispensing device according to embodiments 1-14, wherein the housing further comprises a grip portion positioned on an outer surface of the housing and configured for assisting in the manual grasping of the housing during use of the device.

16. The false eyelash dispensing device according to embodiments 1-15, wherein the grip portion is constructed out of rubber.

17. The false eyelash dispensing device according to embodiments 1-16, wherein the button is positioned on the grip portion.

18. The false eyelash dispensing device according to embodiments 1-17, wherein the at least one lash strip is removably engaged with the corresponding at least one lash belt via an adhesive.

19. A false eyelash dispensing device for applying an at least one false eyelash to an eyelid of a user, the device comprising: an at least one elongate lash belt removably supporting an at least one lash strip thereon, each of the at least one lash strip comprising an at least one false eyelash oriented in a direction substantially transverse to the lash belt; an elongate housing sized and configured for supporting the at least one lash belt therewithin, the housing comprising: an exit opening provided by an exit end of the housing; a lash belt carrier positioned within the housing and comprising: a substantially C-shaped channel positioned and configured for slidably receiving the at least one lash belt therewithin, such that the at least one false eyelash of the at least one lash strip of the at least one lash belt is oriented in a direction substantially transverse to the housing; and an at least one gear in mechanical communication with the at least one lash belt and configured for selectively advancing the at least one lash belt and, in turn, the at least one lash strip longitudinally through the channel toward the exit opening; an eyelash holder positioned laterally adjacent to the channel, directly in front of the exit opening, and comprising a first half and an opposing second half configured for selectively moving in and out of abutting contact with the first half, the eyelash holder configured for selectively moving between one of a retracted position—wherein the eyelash holder is positioned substantially within the housing proximal the exit opening—and an extended position—wherein the eyelash holder extends a distance through the exit opening; and a spring-biased button positioned on an outer surface of the housing, wherein upon the button being manually depressed after the at least one lash belt is selectively advanced via the at least one gear so as to position a one of the at least one lash strip directly in front of the exit opening, substantially flanked by the first and second halves of the eyelash holder, the button is configured for: moving the first and second halves of the eyelash holder into abutting contact with one another, thereby temporarily sandwiching said lash strip therebetween, the eyelash holder engaged laterally across said lash strip such that the at least one false eyelash of said lash strip remains oriented in a direction substantially transverse to the housing; and moving the eyelash holder from the retracted position to the extended position, thereby detaching said lash strip from the lash belt and moving said lash strip through the exit opening so that said lash strip may be subsequently applied to the user's eyelid while engaged with the eyelash holder.

20. A method for applying an at least one false eyelash to an eyelid of a user using the false eyelash dispensing device of claim 1, the method comprising the steps of: inserting a lash belt into the channel of the lash belt carrier; selectively advancing the lash belt within the channel via the at least one gear so as to position a one of the at least one lash strip directly in front of the exit opening of the housing, substantially flanked by the first and second halves of the eyelash holder; manually depressing the button so as to automatically: move the first and second halves of the eyelash holder into abutting contact with one another, thereby temporarily sandwiching said lash strip therebetween, the eyelash holder engaged laterally across said lash strip such that the at least one false eyelash of said lash strip remains oriented in a direction substantially transverse to the housing; and move the eyelash holder from the retracted position to the extended position, thereby detaching said lash strip from the lash belt and moving said lash strip through the exit opening; dipping a free end of said lash strip in an adhesive while said lash strip is engaged with the eyelash holder; applying said lash strip to the user's eyelid while said lash strip is engaged with the eyelash holder; and releasing the button so as to disengage said lash strip from the eyelash holder and move the eyelash holder back into the retracted position.

In closing, regarding the exemplary embodiments of the present invention as shown and described herein, it will be appreciated that a false eyelash dispensing device is disclosed and configured for more easily and uniformly applying an at least one false eyelash to an eyelid of a user. Because the principles of the invention may be practiced in a number of configurations beyond those shown and described, it is to be understood that the invention is not in any way limited by the exemplary embodiments, but is generally directed to a false eyelash dispensing device and is able to take numerous forms to do so without departing from the spirit and scope of the invention. It will also be appreciated by those skilled in the art that the present invention is not limited to the particular geometries and materials of construction disclosed, but may instead entail other functionally comparable structures or materials, now known or later developed, without departing from the spirit and scope of the invention.

Certain embodiments of the present invention are described herein, including the best mode known to the inventor(s) for carrying out the invention. Of course, variations on these described embodiments will become apparent to those of ordinary skill in the art upon reading the foregoing description. The inventor(s) expect skilled artisans to employ such variations as appropriate, and the inventor(s) intend for the present invention to be practiced otherwise than specifically described herein. Accordingly, this invention includes all modifications and equivalents of the subject matter recited in the claims appended hereto as permitted by applicable law. Moreover, any combination of the above-described embodiments in all possible variations thereof is encompassed by the invention unless otherwise indicated herein or otherwise clearly contradicted by context.

Groupings of alternative embodiments, elements, or steps of the present invention are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Unless otherwise indicated, all numbers expressing a characteristic, item, quantity, parameter, property, term, and so forth used in the present specification and claims are to be understood as being modified in all instances by the terms "about" and "approximately." As used herein, the terms "about" and "approximately" mean that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary. At the very least, and not as an attempt to limit the application of the doctrine of equivalents to the scope of the claims, each numerical indication should at least be construed in light of the number of reported significant digits and by applying ordinary rounding techniques. Notwithstanding that the numerical ranges and values setting forth the broad scope of the invention are approximations, the numerical ranges and values set forth in the specific examples are reported as precisely as possible. Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein. Similarly, as used herein, unless indicated to the contrary, the term "substantially" is a term of degree intended to indicate an approximation of the characteristic, item, quantity, parameter, property, or term so qualified, encompassing a range that can be understood and construed by those of ordinary skill in the art.

Use of the terms "may" or "can" in reference to an embodiment or aspect of an embodiment also carries with it the alternative meaning of "may not" or "cannot." As such, if the present specification discloses that an embodiment or an aspect of an embodiment may be or can be included as part of the inventive subject matter, then the negative limitation or exclusionary proviso is also explicitly meant, meaning that an embodiment or an aspect of an embodiment may not be or cannot be included as part of the inventive subject matter. In a similar manner, use of the term "optionally" in reference to an embodiment or aspect of an embodiment means that such embodiment or aspect of the embodiment may be included as part of the inventive subject matter or may not be included as part of the inventive subject matter. Whether such a negative limitation or exclusionary proviso applies will be based on whether the negative limitation or exclusionary proviso is recited in the claimed subject matter.

The terms "a," "an," "the" and similar references used in the context of describing the present invention (especially in the context of the following claims) are to be construed to cover both the singular and the plural, unless otherwise indicated herein or clearly contradicted by context. Further, ordinal indicators—such as "first," "second," "third," etc.—for identified elements are used to distinguish between the elements, and do not indicate or imply a required or limited number of such elements, and do not indicate a particular position or order of such elements unless otherwise specifically stated. All methods described herein can be performed in any suitable order unless otherwise indicated herein or otherwise clearly contradicted by context. The use of any and all examples, or exemplary language (e.g., "such as") provided herein is intended merely to better illuminate the present invention and does not pose a limitation on the scope of the invention otherwise claimed. No language in the present specification should be construed as indicating any non-claimed element essential to the practice of the invention.

When used in the claims, whether as filed or added per amendment, the open-ended transitional term "comprising" (along with equivalent open-ended transitional phrases thereof such as "including," "containing" and "having") encompasses all the expressly recited elements, limitations, steps and/or features alone or in combination with un-recited subject matter; the named elements, limitations and/or features are essential, but other unnamed elements, limitations and/or features may be added and still form a construct within the scope of the claim. Specific embodiments disclosed herein may be further limited in the claims using the closed-ended transitional phrases "consisting of" or "consisting essentially of" in lieu of or as an amendment for "comprising." When used in the claims, whether as filed or added per amendment, the closed-ended transitional phrase "consisting of" excludes any element, limitation, step, or feature not expressly recited in the claims. The closed-ended transitional phrase "consisting essentially of" limits the scope of a claim to the expressly recited elements, limitations, steps and/or features and any other elements, limitations, steps and/or features that do not materially affect the basic and novel characteristic(s) of the claimed subject matter. Thus, the meaning of the open-ended transitional phrase "comprising" is being defined as encompassing all the specifically recited elements, limitations, steps and/or features as well as any optional, additional unspecified ones. The meaning of the closed-ended transitional phrase "consisting of" is being defined as only including those elements, limitations, steps and/or features specifically recited in the claim, whereas the meaning of the closed-ended transitional phrase "consisting essentially of" is being defined as only including those elements, limitations, steps and/or features specifically recited in the claim and those elements, limitations, steps and/or features that do not materially affect the basic and novel characteristic(s) of the claimed subject matter. Therefore, the open-ended transitional phrase "comprising" (along with equivalent open-ended transitional phrases thereof) includes within its meaning, as a limiting case, claimed subject matter specified by the closed-ended transitional phrases "consisting of" or "consisting essentially of." As such, embodiments described herein or so claimed with the phrase "comprising" are expressly or inherently unambiguously described, enabled and supported herein for the phrases "consisting essentially of" and "consisting of."

Any claims intended to be treated under 35 U.S.C. § 112(f) will begin with the words "means for," but use of the term "for" in any other context is not intended to invoke treatment under 35 U.S.C. § 112(f). Accordingly, Applicant reserves the right to pursue additional claims after filing this application, in either this application or in a continuing application.

It should be understood that the methods and the order in which the respective elements of each method are performed are purely exemplary. Depending on the implementation, they may be performed in any order or in parallel, unless indicated otherwise in the present disclosure.

All patents, patent publications, and other publications referenced and identified in the present specification are individually and expressly incorporated herein by reference in their entirety for the purpose of describing and disclosing, for example, the compositions and methodologies described in such publications that might be used in connection with the present invention. These publications are provided solely for their disclosure prior to the filing date of the present application. Nothing in this regard should be construed as an admission that the inventors are not entitled to antedate such disclosure by virtue of prior invention or for any other reason. All statements as to the date or representation as to the contents of these documents is based on the information available to the applicant and does not constitute any admission as to the correctness of the dates or contents of these documents.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A false eyelash dispensing device for applying an at least one false eyelash to an eyelid of a user, the device comprising:

an at least one elongate lash belt removably supporting an at least one lash strip thereon, each of the at least one lash strip comprising an at least one false eyelash oriented in a direction substantially transverse to the lash belt;

an elongate housing sized and configured for receiving the at least one lash belt therewithin, the housing comprising:

an exit opening provided by an exit end of the housing;

a lash belt carrier positioned within the housing and comprising:

a channel positioned and configured for slidably receiving the at least one lash belt therewithin, such that the at least one false eyelash of the at least one lash strip of the at least one lash belt is oriented in a direction substantially transverse to the housing; and an at least one gear in mechanical communication with the at least one lash belt and configured for selectively advancing the at least one lash belt and, in turn, the at least one lash strip longitudinally through the channel toward the exit opening;

an eyelash holder positioned laterally adjacent to the channel, directly in front of the exit opening, the eyelash holder configured for selectively moving between one of a retracted position—wherein the eyelash holder is positioned substantially within the housing proximal the exit opening—and an extended position—wherein the eyelash holder extends a distance through the exit opening; and a spring-biased button positioned on an outer surface of the housing, wherein upon the button being manually depressed after the at least one lash belt is selectively advanced via the at least one gear so as to position a one of the at least one lash strip directly in front of the exit opening, the button is configured for:

causing the eyelash holder to temporarily engage with said lash strip such that the at least one false eyelash of said lash strip remains oriented in a direction substantially transverse to the housing; and moving the eyelash holder from the retracted position to the extended position, thereby detaching said lash strip from the lash belt and moving said lash strip through the exit opening so that said lash strip may be subsequently applied to the user's eyelid while engaged with the eyelash holder.

2. The false eyelash dispensing device of claim 1, wherein:

the lash belt carrier is removably positionable within the housing; and an opposing entry end of the housing provides an entry opening configured for receiving the at least one lash belt therethrough.

3. The false eyelash dispensing device of claim 2, wherein the housing further comprises an end cap removably engageable with the entry end of the housing and configured for covering the entry opening.

4. The false eyelash dispensing device of claim 2, wherein the housing further comprises a positioning window positioned proximal to the entry opening and adjacent to the eyelash holder, the positioning window configured for providing visual access into the housing.

5. The false eyelash dispensing device of claim 1, wherein the at least one gear is further in mechanical communication with a scrolling dial provided by the housing and configured for being manually rotated in order to actuate the at least one gear.

6. The false eyelash dispensing device of claim 5, wherein the scrolling dial is a wheel.

7. The false eyelash dispensing device of claim 5, wherein the scrolling dial is positioned proximal to the exit end of the housing.

8. The false eyelash dispensing device of claim 5, wherein the scrolling dial is ratcheted.

9. The false eyelash dispensing device of claim 1, wherein the button is positioned proximal to the exit end of the housing.

10. The false eyelash dispensing device of claim 1, wherein the eyelash holder comprises a first half and an opposing second half configured for selectively moving in and out of abutting contact with the first half.

11. The false eyelash dispensing device of claim 10, wherein the first and second halves of the eyelash holder are constructed out of or otherwise coated with a high-friction material with a relatively high durometer hardness.

12. The false eyelash dispensing device of claim 10, wherein:

the eyelash holder provides a laterally oriented pin that slidably extends between the first and second halves of the eyelash holder and rides within a cam slot provided by the button;

whereby, as the button is depressed, the pin travels along the cam slot which, in turn, causes the first and second halves of the eyelash holder to move into abutting contact with one another, while also moving the eyelash holder into the extended position; and whereby, upon the button being subsequently released, the pin travels in an opposite direction along the cam slot which, in turn, causes the first and second halves of the eyelash holder to move out of abutting contact with one another, while also moving the eyelash holder into the retracted position.

13. The false eyelash dispensing device of claim 1, wherein the housing further comprises a solenoid positioned within the housing and configured for selectively moving the eyelash holder between the retracted position and extended position.

14. The false eyelash dispensing device of claim 1, wherein the eyelash holder further provides a cutter positioned and configured for selectively cutting the at least one lash strip, when said lash strip is sandwiched between the first and second halves of the eyelash holder, so as to detach said lash strip from the corresponding at least one lash belt.

15. The false eyelash dispensing device of claim 1, wherein the housing further comprises a grip portion positioned on an outer surface of the housing and configured for assisting in the manual grasping of the housing during use of the device.

16. The false eyelash dispensing device of claim 15, wherein the grip portion is constructed out of rubber.

17. The false eyelash dispensing device of claim 15, wherein the button is positioned on the grip portion.

18. The false eyelash dispensing device of claim 1, wherein the at least one lash strip is removably engaged with the corresponding at least one lash belt via an adhesive.

19. A method for applying an at least one false eyelash to an eyelid of a user using the false eyelash dispensing device of claim 1, the method comprising the steps of:

inserting a lash belt into the channel of the lash belt carrier;

selectively advancing the lash belt within the channel via the at least one gear so as to position a one of the at least one lash strip directly in front of the exit opening of the housing;

manually depressing the button so as to automatically:

cause the eyelash holder to temporarily engage with said lash strip such that the at least one false eyelash of said lash strip remains oriented in a direction substantially transverse to the housing; and move the eyelash holder from the retracted position to the extended position, thereby detaching said lash strip from the lash belt and moving said lash strip through the exit opening;

dipping a free end of said lash strip in an adhesive while said lash strip is engaged with the eyelash holder;

applying said lash strip to the user's eyelid while said lash strip is engaged with the eyelash holder; and releasing the button so as to disengage said lash strip from the eyelash holder and move the eyelash holder back into the retracted position.

20. A false eyelash dispensing device for applying an at least one false eyelash to an eyelid of a user, the device comprising:

an at least one elongate lash belt removably supporting an at least one lash strip thereon, each of the at least one lash strip comprising an at least one false eyelash oriented in a direction substantially transverse to the lash belt;

an elongate housing sized and configured for supporting the at least one lash belt therewithin, the housing comprising:

an exit opening provided by an exit end of the housing;

a lash belt carrier positioned within the housing and comprising:

a channel positioned and configured for slidably receiving the at least one lash belt therewithin, such that the at least one false eyelash of the at least one lash strip of the at least one lash belt is oriented in a direction substantially transverse to the housing; and an at least one gear in mechanical communication with the at least one lash belt and configured for selectively advancing the at least one lash belt and, in turn, the at least one lash strip longitudinally through the channel toward the exit opening;

an eyelash holder positioned laterally adjacent to the channel, directly in front of the exit opening, and comprising a first half and an opposing second half configured for selectively moving in and out of abutting contact with the first half, the eyelash holder configured for selectively moving between one of a retracted position—wherein the eyelash holder is positioned substantially within the housing proximal the exit opening—and an extended position—wherein the eyelash holder extends a distance through the exit opening; and a spring-biased button positioned on an outer surface of the housing, wherein upon the button being manually depressed after the at least one lash belt is selectively advanced via the at least one gear so as to position a one of the at least one lash strip directly in front of the exit opening, substantially flanked by the first and second halves of the eyelash holder, the button is configured for:

moving the first and second halves of the eyelash holder into abutting contact with one another, thereby temporarily sandwiching said lash strip therebetween, the eyelash holder engaged laterally across said lash strip such that the at least one false eyelash of said lash strip remains oriented in a direction substantially transverse to the housing; and moving the eyelash holder from the retracted position to the extended position, thereby detaching said lash strip from the lash belt and moving said lash strip through the exit opening so that said lash strip may be subsequently applied to the user's eyelid while engaged with the eyelash holder.

* * * * *